US006154997A

United States Patent [19]

Aluotto et al.

[11] Patent Number: 6,154,997

[45] Date of Patent: Dec. 5, 2000

[54] MAGAZINE POUCH

[76] Inventors: Peter A. Aluotto, 1668 Hendrickson St.; John A. Gulardo, 1866 E. 53rd St., both of Brooklyn, N.Y. 11234

[21] Appl. No.: 09/295,874

[22] Filed: Apr. 21, 1999

[51] Int. Cl.[7] ..... F41A 15/00

[52] U.S. Cl. ..... 42/90; 42/106; 224/239; 224/931

[58] Field of Search ..... 42/88, 90, 106; 89/34; 224/239, 931, 191, 587, 668, 673, 240, 914

[56] References Cited

U.S. PATENT DOCUMENTS

| | | | |
|---|---|---|---|
| 1,756,677 | 4/1930 | Cook | 224/239 |
| 2,756,913 | 7/1956 | Oswald | 224/15 |
| 5,152,442 | 10/1992 | Gallagher | 224/245 |
| 5,303,860 | 4/1994 | Seratini, Jr. | 224/348 |
| 5,484,093 | 1/1996 | Hellweg et al. | 224/253 |

*Primary Examiner*—J. Woodrow Eldred
*Attorney, Agent, or Firm*—Pitney, Hardin, Kipp & Szuch LLP

[57] ABSTRACT

A magazine pouch has a backing plate with an upper portion and a lower portion. The upper portion has a channel oriented longitudinally along said backing plate. A retainer is slidingly disposed in the channel and fixable in several preselected positions. The lower portion has a magazine box in which a magazine may be disposed. The magazine box includes a front wall and an opening facing the channel. The front wall includes a tab adjacent the opening. The tab is resilient, and, in the manner of a spring, keeps a magazine secured under the retainer, yet enables the magazine to be quickly removed from the pouch.

6 Claims, 5 Drawing Sheets

MAGAZINE POUCH

BACKGROUND OF THE INVENTION

1. Field of the Invention

The present invention relates generally to the field of handguns and small firearms. More specifically, the present invention relates to the variety of handgun which may be loaded with ammunition by inserting a magazine into the lower end of its stock or handle. In particular, the present invention is a pouch, designed to be attached to a user's belt, for the temporary storage of such a magazine.

2. Description of the Prior Art

Handguns of numerous varieties are widely used by police and military officers, as well as by civilian hobbyists and gun enthusiasts. Typically, handguns of these types are loaded by inserting an ammunition-bearing magazine into the stock or handle. The magazine, when fully loaded, may hold ten or more rounds.

The user of such a handgun will often want to carry one or more extra loaded magazines for insertion thereinto when the rounds in a given magazine have been fired. The prior art is replete with magazine pouches which have been designed to hold extra magazines.

For example, in one recently issued U.S. patent, U.S. Pat. No. 5,152,442, a case for storing and transporting a clip of cartridges is shown. A user can remove the clip from the case by inserting his thumb intermediate the clip and the backing of the case and by grasping the clip between his or her thumb and forefinger. The case is attached to the belt of the user, and includes a flap, which is held in a closed position over the clip by a hook-and-loop (VELCRO®) fastener.

In another, U.S. Pat. No. 5,484,093, a magazine pouch having a main body portion and a belt loop portion is shown. The main body portion and the belt loop portion are formed as a one-piece construction. The main body portion has an open top for receiving a magazine therein, and a closed bottom for retaining the magazine.

The shortcomings of the magazine pouches shown in these patents are typical of those of the prior art. In the first patent, the user must open a flap to gain access to the magazine therein. In the other patent, while there is no flap, there is nothing to keep the magazine from bouncing and falling out, especially when the user moves in a way that jostles the pouch. In the police and military arenas, where the magazine must be held securely within a pouch, yet must be quickly removable, pouches of these type leave the user at a distinct disadvantage.

Clearly, there is a need for a magazine pouch having a means, other than a flap, for keeping a magazine therein, at the same time as permitting a user to quickly remove the magazine for insertion into a firearm. That need is met by the present invention.

SUMMARY OF THE INVENTION

Accordingly, the present invention is a magazine pouch which comprises a backing plate having an upper portion and a lower portion. The upper portion has a channel which is oriented longitudinally on said backing plate.

A magazine box is on the lower portion of the backing plate. The magazine box has a back wall, a first side wall, a second side wall and a front wall which together define an opening. The front wall includes a tab adjacent the opening. When displaced from an original position in a direction away from said back wall, the tab springingly restores itself to the original position. The back wall of the magazine box is on the lower portion of the backing plate, and the opening of the magazine box faces the channel.

A retainer is slidingly disposed in the channel and is fixable at preselected positions therein.

The present invention will now be described in more complete detail with frequent reference being made to the figures identified below.

DETAILED DESCRIPTION OF THE PREFERRED EMBODIMENT

Figure 1:
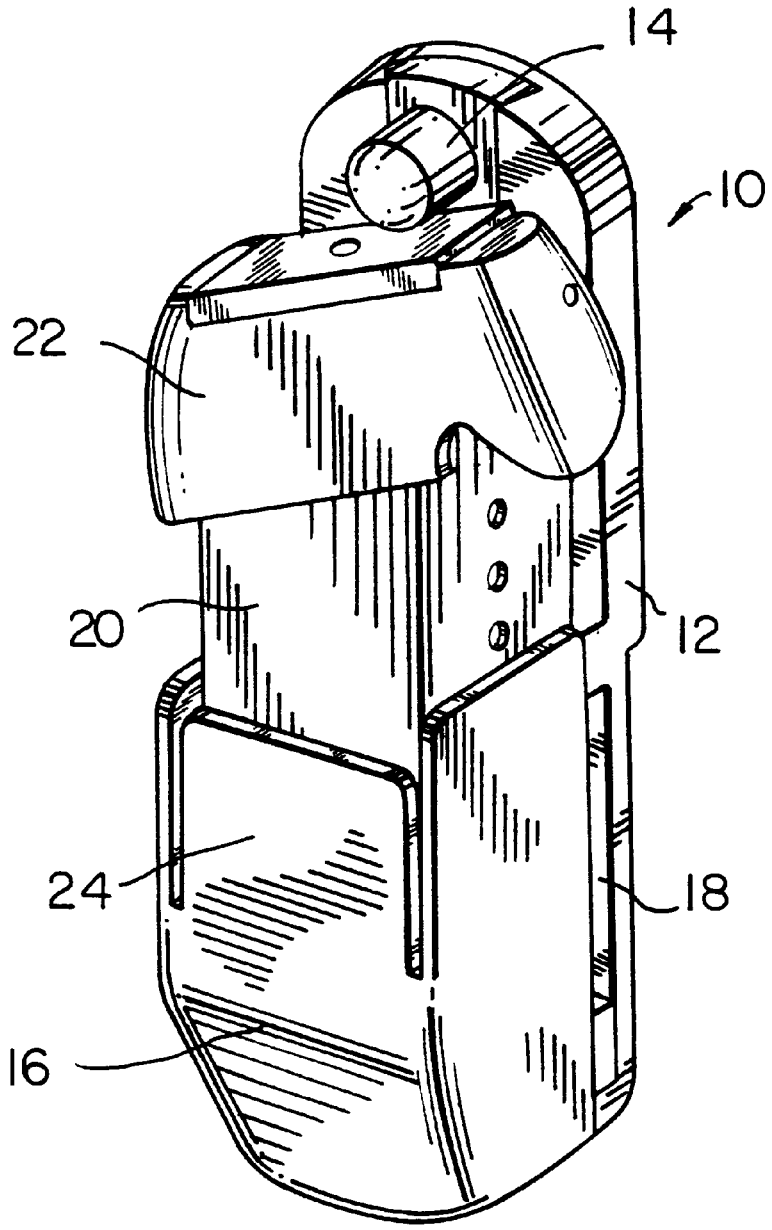
FIG. 1 is a perspective view of the magazine pouch of the present invention.

Turning now to these drawing figures, FIG. 1 is a perspective view of the magazine pouch 10 of the present invention. The magazine pouch 10 includes three principal parts: a backing plate 12, a retainer 14, and a magazine box 16. As will be shown more clearly below, the retainer 14 is slidably disposed in a channel on the backing plate 12, where it may be fixed at one of several positions to accommodate magazines of different size.

The magazine box 16 is mounted onto and secured to backing plate 12. The backing plate 12 and magazine box 16 are shaped so as to create, when the two are joined together, a belt passage 18 for use in mounting the magazine pouch 10 at the waist of a user.

Disposed in the magazine box 16 is a magazine 20, which is shown solely for the purposes of illustration and is not a part of the present invention. Disposed about an end of the magazine 20 is a stock extender 22 of the type disclosed and claimed in the Applicants' U.S. Pat. No. 5,341,586, the teachings of which are incorporated herein by reference. As discussed therein, the stock extender 22 provides an effective way to lengthen the stock of a small handgun through use in conjunction with a longer magazine than is intended for the handgun, thereby enabling a large-handed user to handle a small handgun more reliably and safely, and to enable him or her to grip such a handgun with his or her entire hand.

Figure 2:
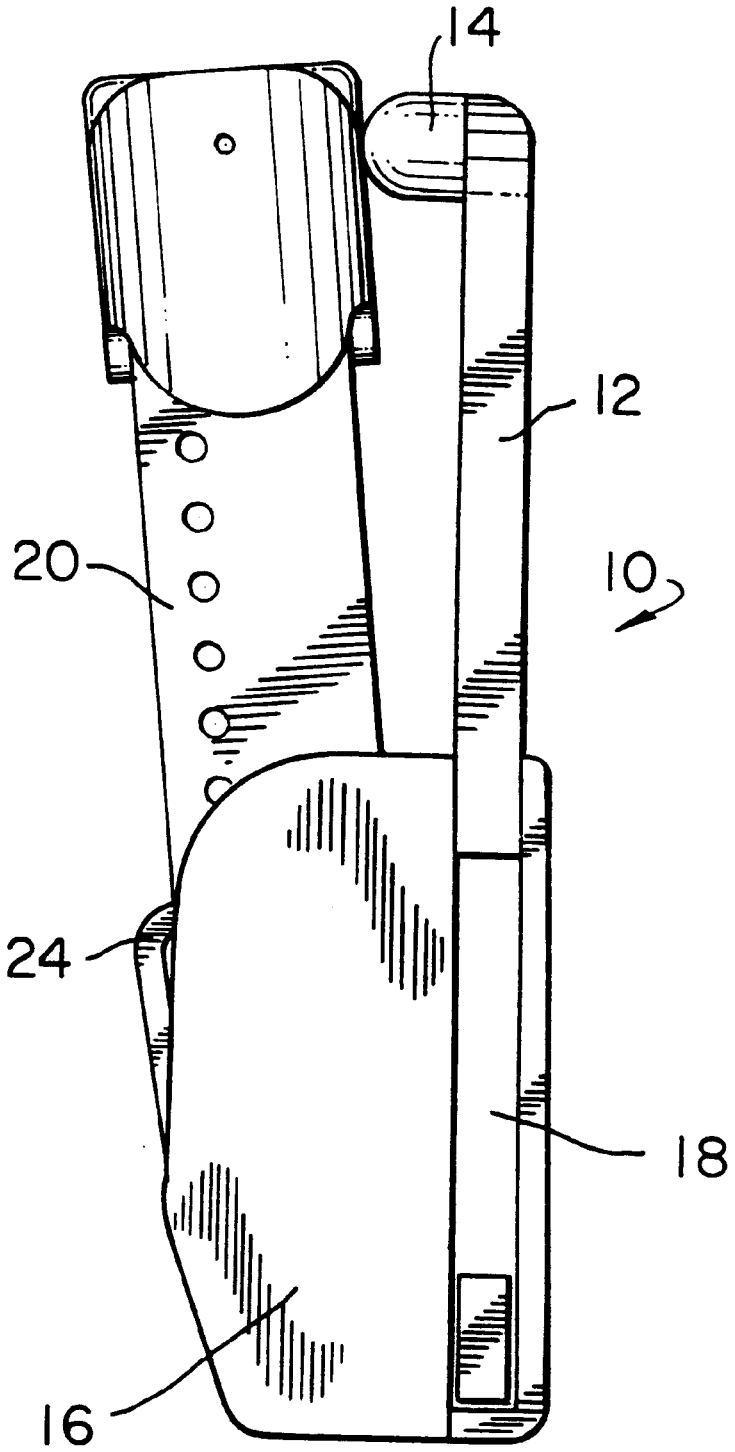
FIG. 2 is a side view of the magazine pouch showing the manner in which a magazine may be removed therefrom.

FIG. 2 is a side view of the magazine pouch 10 showing the manner in which the magazine 20 may be removed therefrom. To do so, the top of magazine 20 is pulled outward, or to the left in FIG. 2, to a point where it is clear of retainer 14, and then pulled upward, removing its other end from magazine box 16.

The magazine box 16 includes a tab 24 which, when bent outward as in FIG. 2, exerts a spring-like force in the opposite direction. Clearly, the tab 24, in combination with the retainer 14, keeps the magazine 20 in the magazine pouch 10 until it is needed, but enables it to be removed readily and quickly at that time. Until that time, the retainer 14 prevents the magazine 20 from bouncing out of the magazine pouch 10 unintentionally, and the spring force produced by the tab 24 keeps the magazine 20 under the retainer 14.

Figure 3:
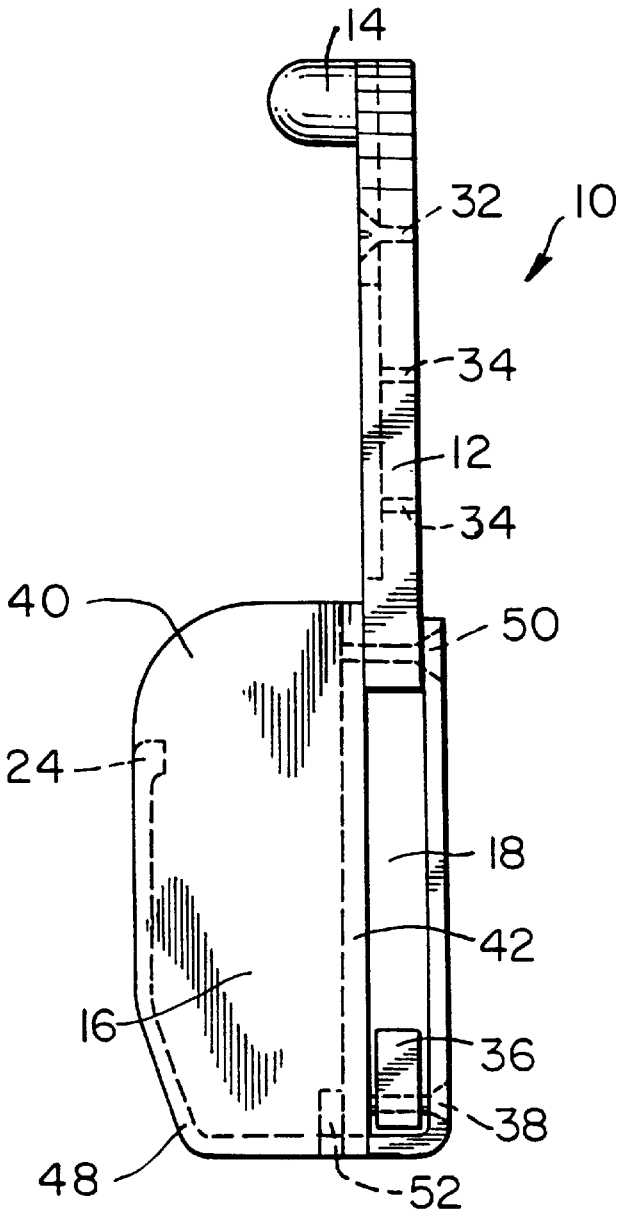
FIG. 3 is a side view of the magazine pouch.
Figure 4:
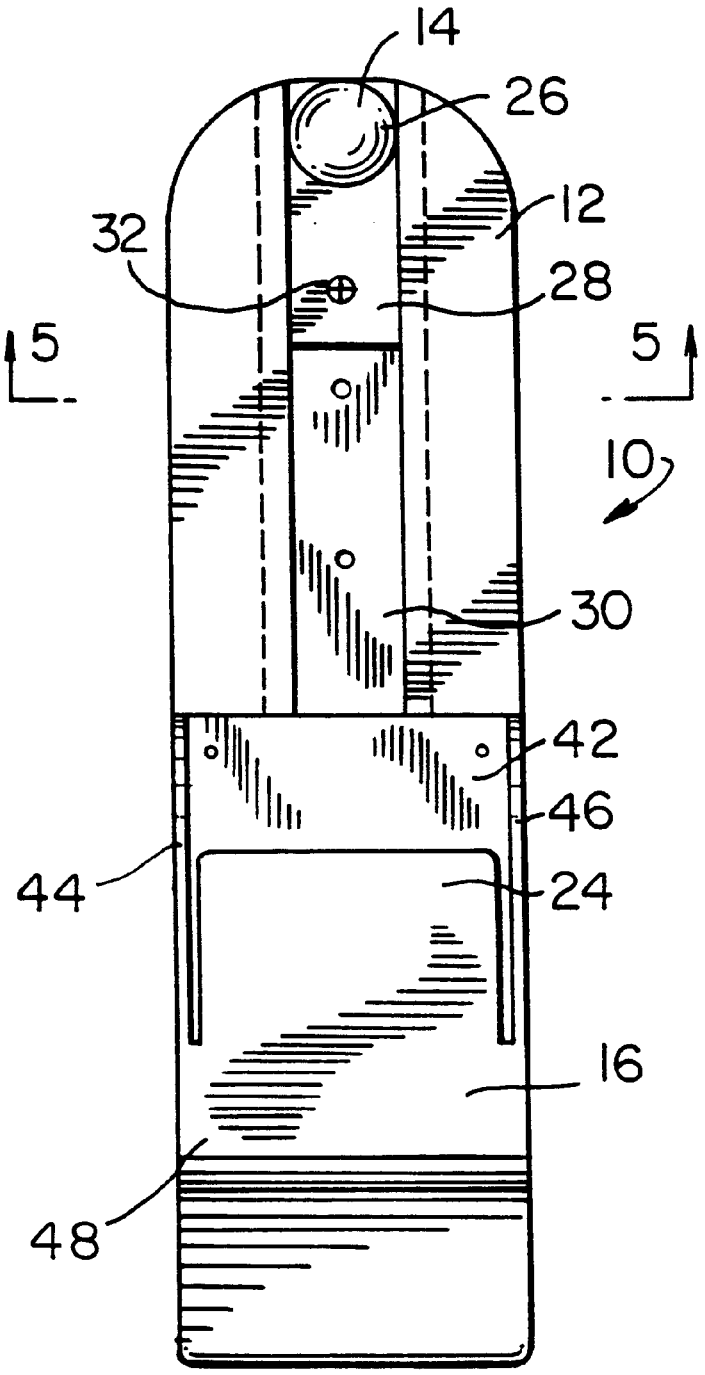
FIG. 4 is a front view thereof.
Figure 5:
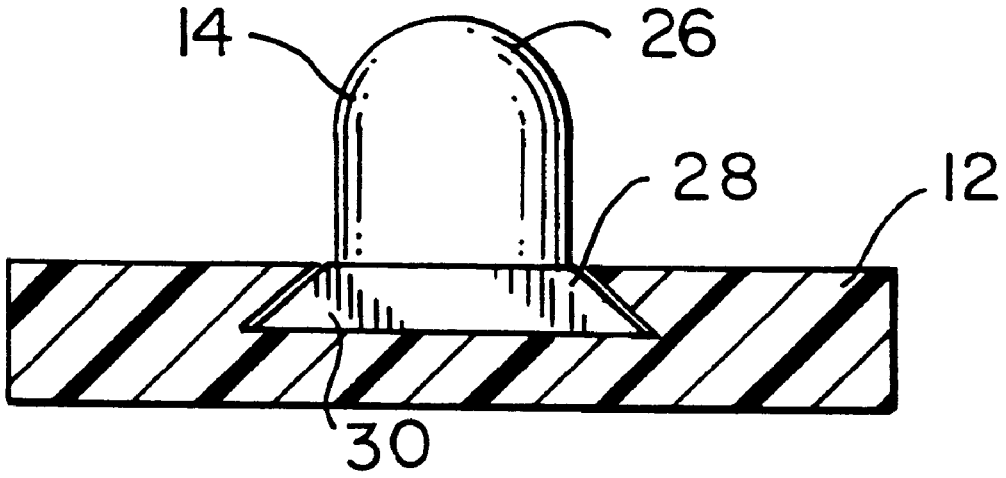
FIG. 5 is a cross-sectional view taken as indicated by line 5—5 in FIG. 4.

Turning now to FIGS. 3 and 4, which are a side view and a front view respectively, of the magazine pouch 10 without a magazine 20 disposed therein, phantom lines therein illustrate several additional characteristics of the invention. Retainer 14 comprises a button 26 and a base 28, which is slidably disposed in channel 30 in backing plate 12. Retainer 14, as suggested by screw 32 and holes 34, may be set to different vertical positions in channel 30 to accommodate magazines 20 of different length. In this regard, FIG. 5 is a cross-sectional view, taken as indicated by line 5—5 in FIG. 4, showing the channel 30 and base 20 to have a dove-tail relationship for greater stability.

Referring again to FIG. 3, belt passage 18, formed between backing plate 12 and magazine box 16, may be adjusted to match the width of the belt of a user through the use of spacer plate 36. Spacer plate 36 may be held in place by screw 38. If necessary, spacer plate 36 may be entirely removed, or replaced with another of less or greater width, depending on the width of the belt of the user.

Magazine box 16, as implied by the above, is attached to the backing plate 12, and is in the form of a receptacle whose opening 40 faces the retainer 14. The magazine box 16 has a back wall 42, which, in conjunction with backing plate 12, forms belt passage 18. The magazine box 16 also has a first side wall 44, a second side wall 46, and a front wall 48, which includes tab 24. The attachment of the magazine box 16 to the backing plate 12 may be made by any means known to those of ordinary skill in the art for such purposes, such as screws 50, one of which is visible in phantom in FIG. 3, with or without the tab 52, provided at the bottom of backing plate 12, which passes through a hole in the bottom of the magazine box 16.

It will be noted in FIG. 4 that each side of the magazine pouch 10 is the mirror image of the other, and, as a consequence, it may be worn by either right-handed or left-handed persons on either side of their bodies.

Except possibly for screws 32,38,50, the components of the present magazine pouch 10 may be molded from a plastic material, particularly a nylon-filled plastic material which will provide tab 24 with the requisite springiness. While the screws could also be of a plastic material, it could also be of a plastic material, it is more typical that they be of metal.

Those in the art will realize that the backing plate 12 and magazine box 16 could be integrally molded as one piece, rather than being provided separately as two pieces. Moreover, instead of including a belt passage 18, whose width could be changed with the addition or removal of spacer plates 36, the backing plate could be provided with an integrally molded clip, which could be used to attach the magazine pouch 10 to a belt of any width.

Modifications to the above would be obvious to those of ordinary skill in the art, but would not bring the invention so modified beyond the scope of the appended claims.

What is claimed is:

1. A magazine pouch, said magazine pouch comprising:

a backing plate, said backing plate having an upper portion and a lower portion, said upper portion having a channel oriented longitudinally along said backing plate;

a magazine box, said magazine box having a back wall, a first side wall, a second side wall and a front wall which together define an opening, said front wall including a tab adjacent said opening which, when displaced from an original position in a direction away from said back wall, springingly restores itself to said original position, said back wall of said magazine box being on said lower portion of said backing plate and said opening of said magazine box facing said channel; and a retainer, said retainer being slidingly disposed in said channel and fixable at preselected positions therein.

2. A magazine pouch as claimed in claim 1 wherein said back wall of said magazine box and said lower portion of said backing plate are separated from one another, thereby providing a belt passage so that said magazine pouch may be mounted on the belt of a user.

3. A magazine pouch as claimed in claim 1 wherein said backing plate further comprises a clip, whereby said magazine pouch may be attached to the belt of a user.

4. A magazine pouch as claimed in claim 1 wherein said magazine box is molded from a resilient plastic material.

5. A magazine pouch as claimed in claim 4 wherein said plastic material is nylon-filled.

6. A magazine pouch as claimed in claim 2 further comprising a spacer plate, said spacer plate being disposed and fixed within said belt passage, so that said belt passage may be of a width comparable to that of the belt of a user.

* * * * *